US006543067B2

(12) United States Patent
Eddington et al.

(10) Patent No.: US 6,543,067 B2
(45) Date of Patent: Apr. 8, 2003

(54) INTEGRATED MANIFOLD SYSTEM FOR SPAS

(75) Inventors: Richard Alex Eddington, Salt Lake County, UT (US); Stephen M. Fleischer, Orem, UT (US); David Jon Ludlow, Salt Lake County, UT (US)

(73) Assignee: Bullfrog International, L.C., Sandy, UT (US)

( * ) Notice: Subject to any disclaimer, the term of this patent is extended or adjusted under 35 U.S.C. 154(b) by 0 days.

(21) Appl. No.: 09/909,234

(22) Filed: Jul. 19, 2001

(65) Prior Publication Data

US 2003/0024041 A1 Feb. 6, 2003

(51) Int. Cl.[7] ..... E03C 1/048

(52) U.S. Cl. ..... 4/541.1; 4/696; 285/3; 285/31

(58) Field of Search ..... 4/492, 507, 541.1, 4/541.3, 541.4, 541.5, 696; 137/561 A; 285/3, 31, 32, 305, 307

(56) References Cited

U.S. PATENT DOCUMENTS

| | | | | | |
|---|---|---|---|---|---|
| 2,461,828 | A | * | 2/1949 | Lomelino | 285/31 X |
| 3,470,893 | A | * | 10/1969 | Nelson | 285/3 X |
| 4,420,846 | A | * | 12/1983 | Bonner | 4/541.4 |
| 5,011,193 | A | * | 4/1991 | Porte | 285/31 |
| 5,662,360 | A | * | 9/1997 | Guzowski | 285/307 X |
| 5,754,989 | A | | 5/1998 | Ludlow | |
| 5,987,663 | A | * | 11/1999 | Ludlow et al. | 4/541.1 |
| 6,000,073 | A | | 12/1999 | Eddington | |
| 6,092,246 | A | | 7/2000 | Ludlow | |

* cited by examiner

*Primary Examiner*—Robert M. Fetsuga
(74) *Attorney, Agent, or Firm*—Parsons Behle & Latimer; James L. Sonntag

(57) ABSTRACT

A modular spa with an integrated manifold that has telescoping structure that permits easy insertion and length adjustment for installation between water inlet and outlet lines.

18 Claims, 6 Drawing Sheets

INTEGRATED MANIFOLD SYSTEM FOR SPAS

RELATED APPLICATIONS (Not applicable)

FIELD OF THE INVENTION

This invention relates to the construction of spas, hot tubs and bathing systems.

BACKGROUND OF THE INVENTION

A recent advance in the construction of spas is the development of modular construction systems that allow for easier upgrading and repair of the water jet system of a spa. These modular systems are disclosed in U.S. Pat. No. 5,754,989, issued May 26, 1998, titled "PLUMBING AND SHELL SYSTEM FOR SPA", U.S. Pat. No. 6,092,246, issued Jul. 25, 2000, titled "PLUMBING AND SHELL SYSTEM FOR SPA", U.S. Pat. No. 6,000,073, issued Dec. 14, 1999, titled "JET ZONE DISTRIBUTION SYSTEM FOR SPAS," and U.S. Pat. No. 5,987,663, issued Nov. 23, 1999, "MODULAR SYSTEM FOR SPAS AND BATHING SYSTEMS".

In these modular systems, a shell is constructed with depressions or hollows in the shell wall. In each of the hollows are fitted with modular jet pack that comprises a hollow cover upon which are mounted the jets. A water inlet line extends through the shell and to the jets. To remove the jets, either for replacement, repair, or an upgrade to different jets, the water inlet line is disconnected and the cover is removed. To assist in disconnecting the water inlet line from the jet pack, a manifold is provided that allows disconnection and reconnection to the water inlet line. It also contains ports for water supply to multiple jets, and an air supply manifold with ports for air supply lines to the jets.

The water supply system of the spa comprises a water inlet line with multiple jet packs connected through these manifolds in series along the supply line. Each manifold is constructed as a rigid pipe with a water inlet for connection to the water inlet, and an outlet to allow water supply to the next jet pack, becoming the water inlet for that jet pack. From the rigid pipe are ports for the jet supply lines. This is provided by a molded sleeve that comprises the ports for jet water supply line connections, which is bolted or adhered around the pipe. An air manifold molding is also attached to the pipe for the jet air supply. The manifold requires several parts, and assembly is not trivial, requiring cutting and adhesion of parts together.

When a manifold is installed, the pipe that makes up the body of the manifold is positioned between the water inlet line and the water outlet line, which is blocked or leads to a further jet pack assembly. Union connectors are provided, so the installer must line up each end of the manifold, insuring that there will be seal on both ends of the pipe, and then screw on the union connector female sleeves to provide a firm connection and seal.

The manifold system described above has proven successful and has been used commercially. However, there are some problems associated with these manifolds. The main problem is that the manifold pipe or body of the manifold, the water inlet line, and the water outlet line, must be constructed to very close tolerances. In particular the distance between the ends of the water inlet line and the water outlet line must match very closely the length of the manifold. If the manifold pipe is too short, it will be difficult or impossible to seal the unions. If the manifold pipe is to long, the manifold itself cannot be placed and installed. However, even if the manifold length and distance between the water line ends precisely match, it can still difficult to insert the manifold between water lines because of the close fit that is required. Basically the problem here is two-fold: (1) if the distance between the ends of the water lines must be very exact, or the manifold will not between fit or not seal to the lines; (2) even if the water lines are correctly and precisely placed, the close tolerances between the manifold and the water inlet lines make it difficult to insert the manifold between the water line ends and make the attachments.

Another problem is that the manifold comprises several separate parts that must be separately manufactured and then assembled into the final product. For a mass production system, this system is too costly in parts and assembly time.

What is desired is a manifold system for modular spa systems, that is easier to install, requires less precision in the distance between the water lines, and is less expensive to manufacture.

OBJECTS OF THE INVENTION

It is, therefore, an object of the invention to provide a manifold system for modular spas that is easier to install.

Another object of the invention is to provide a manifold system for modular spas that allows less precise tolerances in manufacture of the manifold, and the distance between the water inlet and water outlet lines.

Another object of the invention is a manifold system for modular spas that requires fewer parts and less assembly time.

Further objects of the invention will become evident in the description below.

BRIEF SUMMARY OF THE INVENTION

The present invention is an improvement in the above cited modular bathing or spa systems. As described above, these are systems for a bathing or spa vessel comprising a shell for containment of water. The water distribution system comprises a manifold comprising at least one water port for supplying water to a water jet, a water inlet, a hollow interior to provide water communication between the water inlet and the water port, and attachment ends with structure for fitting the manifold to two fixed attachments on the vessel. In a preferred embodiment, the attachments are two water lines, a water inlet line, and a water outlet line, that are aligned on a common longitudinal axis. Water is supplied from the water inlet line, which then flows through the ports to water jets and through the water outlet if there is a further jet pack assembly with a water manifold. In these systems, the manifold has structure on each of its two ends to attach and seal the manifold to the water lines when the longitudinal axis of the manifold is aligned with the longitudinal axis of the water lines. The manifold has a hollow interior to provide water communication between the water inlet, the water outlet, and water port. When the attachments of the vessel to not correspond to water lines, other suitable attachments are contemplated. In addition, in some installations, only a water inlet may be required, thus none of the attachments is a water outlet line. In such an embodiment, the attachment may be structure for fitting similar to the water line, (e.g., with unions, or the like, but be associated with a blind fitting. As background information and as illustration of the state of the art, suitable constructions of modular bathing systems used in conjunction with the present invention are disclosed in U.S. Pat. No. 5,754,989, issued May 26, 1998, titled "PLUMBING AND SHELL SYSTEM FOR SPA", U.S. Pat. No. 6,092,246, issued Jul. 25, 2000, titled "PLUMBING AND SHELL SYSTEM FOR SPA", U.S. Pat. No. 6,000,073, issued Dec. 14, 1999, titled "JET ZONE DISTRIBUTION SYSTEM FOR SPAS," and U.S. Pat. No. 5,987,663, issued Nov. 23, 1999, "MODULAR SYSTEM FOR SPAS AND BATHING SYSTEMS," which are hereby incorporated by reference.

The present invention is an improvement on this system using a new manifold construction that comprises a tubular main section with a first end and a second end and with a channel between the first end and the second end. There is an integral structure to provide at least one water port for the jet which communicates with the channel.

A tubular end section is attached with its proximate end overlapping a first end of the main section in a telescoping construction. This is to enable the end section to slide along the main section to change the length of the manifold. A distal end of the end section comprises structure to provide attachment ends of the manifold so that it can be attached to the water lines.

The manifold preferably has two end sections, one at each end of the main section as illustrated below. However, it is within contemplation of the invention to have only one end section that telescopes on one end of the main section, with structure on the end section and the on the main section for the two attachments. The function of an end section is to allow an installer to compress the end section to shorten the length of the manifold so that it can easily be inserted between the ends of the water lines. The end section or sections are then pulled out to lengthen the manifold to the precise length required to seal against the water line ends. The advantage here it two-fold (1) it is easier than the prior-art manifold to insert in position between the water lines, and (2) it is not necessary to precisely space the distance between the water line ends during manufacture of the spa in order for the manifold to fit properly and seal properly at the attachments. The end sections may be constructed to overlap and slide over the exterior surface of the main section, or, as illustrated below, be constructed to overlap and slide inside the channel of the main section.

The structure to provide the ports is integral to the main section. Any suitable construction in contemplated, but the port structure and the main section are preferably molded as a one-piece structure. Molding not only provides an economical way to mass produce the part, but part itself has superior properties. A molded part means that structurally the material of the part is continuous throughout the part without any seams, joints, or other such discontinuities in the part that may weaken the part.

The water ports communicate with the interior of the manifold so that water can flow from the water inlet through the ports to supply lines for the water jets. One or more ports are contemplated, but it is preferred that the number of ports molded into the part represent the maximum number of ports that are used in any jet pack configuration. Then only one manifold model is manufactured for all jet packs and only the ports needed are actually used. The unused ports may be plugged off. Preferably the ports, as molded, have a breakaway wall in the port that blocks the flow of water. If a port is to be used, the wall is broken out and a jet water supply line is attached to the port. If the port is not used, the wall is left as-is to block water flow from the port.

In many spa installations, jets require an air line from the jet to the open air or a pressurized air supply. Through these lines, water is sucked by the water action or pushed through the jet to provide a more vigorous jet action. Accordingly, structure to provide an air supply to the jets is preferred. This structure may comprise an air supply manifold with at least one air port to provide an air supply for the jet. The structure to provide the air port is preferably molded integrally with the main section, the same as with the structure for the water port. Again as with the water ports, the number of air ports preferably corresponds with the maximum number of jets that may be attached to the manifold, with breakaway walls in the ports that will be left for unused ports.

The end sections are also preferably molded from the same material as the main section. Suitable materials for both include any material that is adaptable to molding into the suitable structure required for the manifold. These include, but are not limited to, plastics, metals, fiber/resin composites, and the like. The attachment structures for attachment to the water lines, whether they are on a main section or an end sections for attachments, can be any suitable structure. Preferably the structures are the same as or similar to conventional plumbing fittings, such as threaded union fittings, as illustrated below, or compression fittings, flange fittings, bayonet fittings, or the like. The requirement is that the fittings allow nondestructive removal and then reattachment of a manifold to the water lines.

The tubular main section and end sections are preferably cylindrical with a circular cross-section, as this construction is adaptable for suitable telescoping structures and for forming the attachments ends. However, any other tubular construction that functions as described is contemplated. The cross-section may be non-circular, such as polygonal, ovoid, or partially circular with one or more flat sides. A non-circular cross-section may be used to prevent the telescoping parts from rotating relative to each other during installation of the manifold. In addition, the cross-section may vary in size and shape along the length of the manifold, for example, circular at the attachment ends and non-circular at the telescoping region.

As used herein, reference to "water jets" of "water jet" includes those devices that inject water or water and air through an opening into the spa containment. However, it is also contemplated by this term to include those devices used in spas that are not strictly jets by involve the passage of water into the interior of the spa. These include, for example, water diffusers, water massagers, and systems with moving mechanical devices to affect the water flow.

INDEX OF REFERENCE NUMBERS

Figure 1:
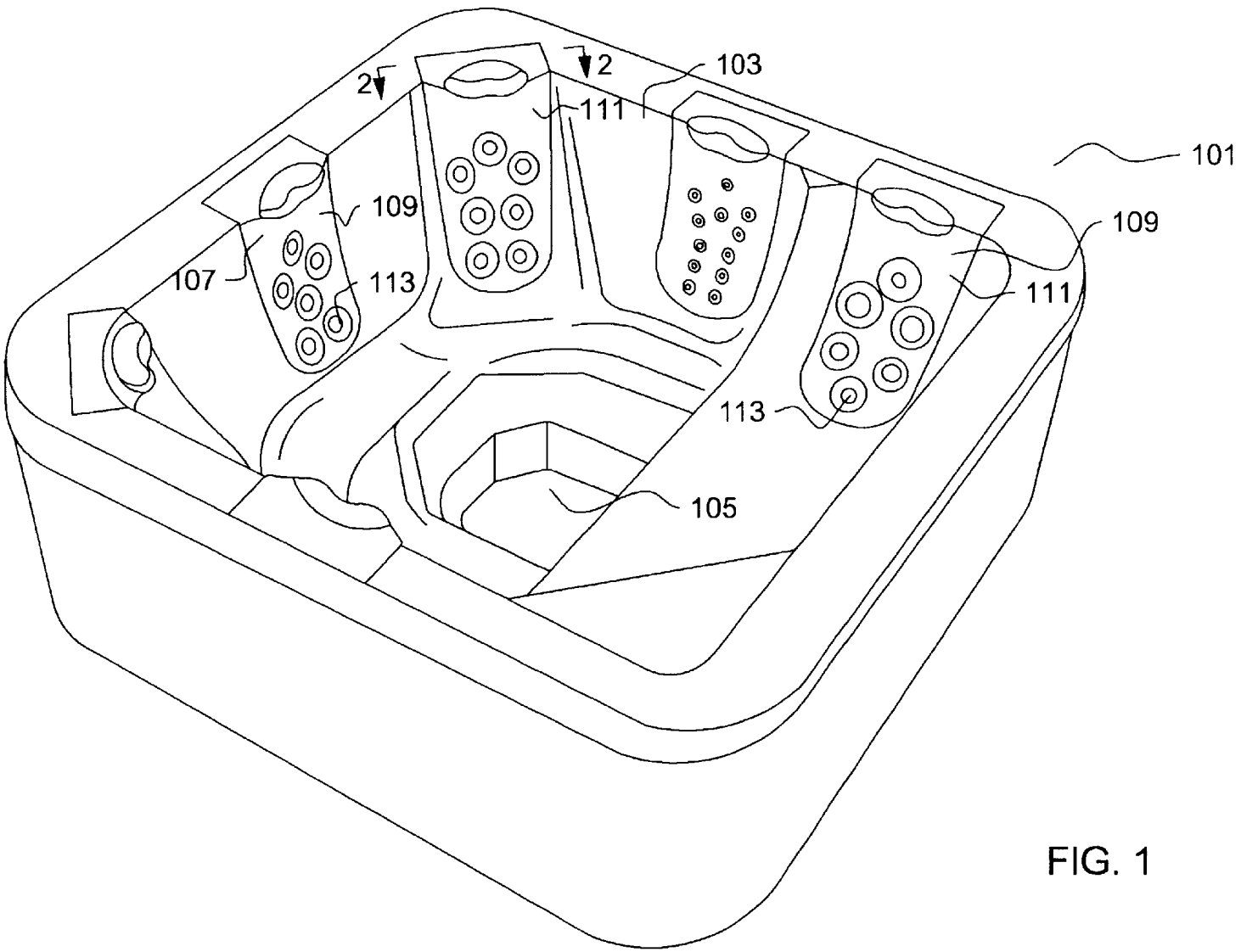
FIG. 1 is a perspective view from above of a modular spa system.

101 modular spa
103 shell
105 containment
107 hollow
109 jet packs
111 jet pack cover
113 water jet
115 manifold
117 water inlet line
119 water outlet line
120 axis of water lines
121 end of water inlet line
122 longitudinal axis of manifold
123 end of water exit line
125 water ports
127 jet water supply lines
129 air manifold
131 air port
133 jet air supply lines
135 main section of manifold
137 end section
139 proximate ends of end section
140 channel of main section
141 distal end of end section
143 lip
145 female sleeve
147 seal ring
149 male union threads
151 union seal
153 protrusion
155 aperture
157 breakout wall in water port
129 air manifold
163 air opening in air manifold
169 break away wall in air port
171- anti-siphon port
180 water distribution system
181 water inlet
182 hollow interior
183 attachment end
184 structure to fit manifold to attachment
185 fixed attachment
186 first end of main section
187 second end of main section
188 channel
189 integral structure
190 cross-section of main section
191 cross-section tubular end section
192 water outlet

DETAILED DESCRIPTION OF THE INVENTION

Reference is now made to FIG. 1. A modular spa 101 comprises a molded shell 103 that provides the containment 105 for water. The shell is molded to provide seats, lounge surfaces, foot wells, as illustrated.

Figure 2:
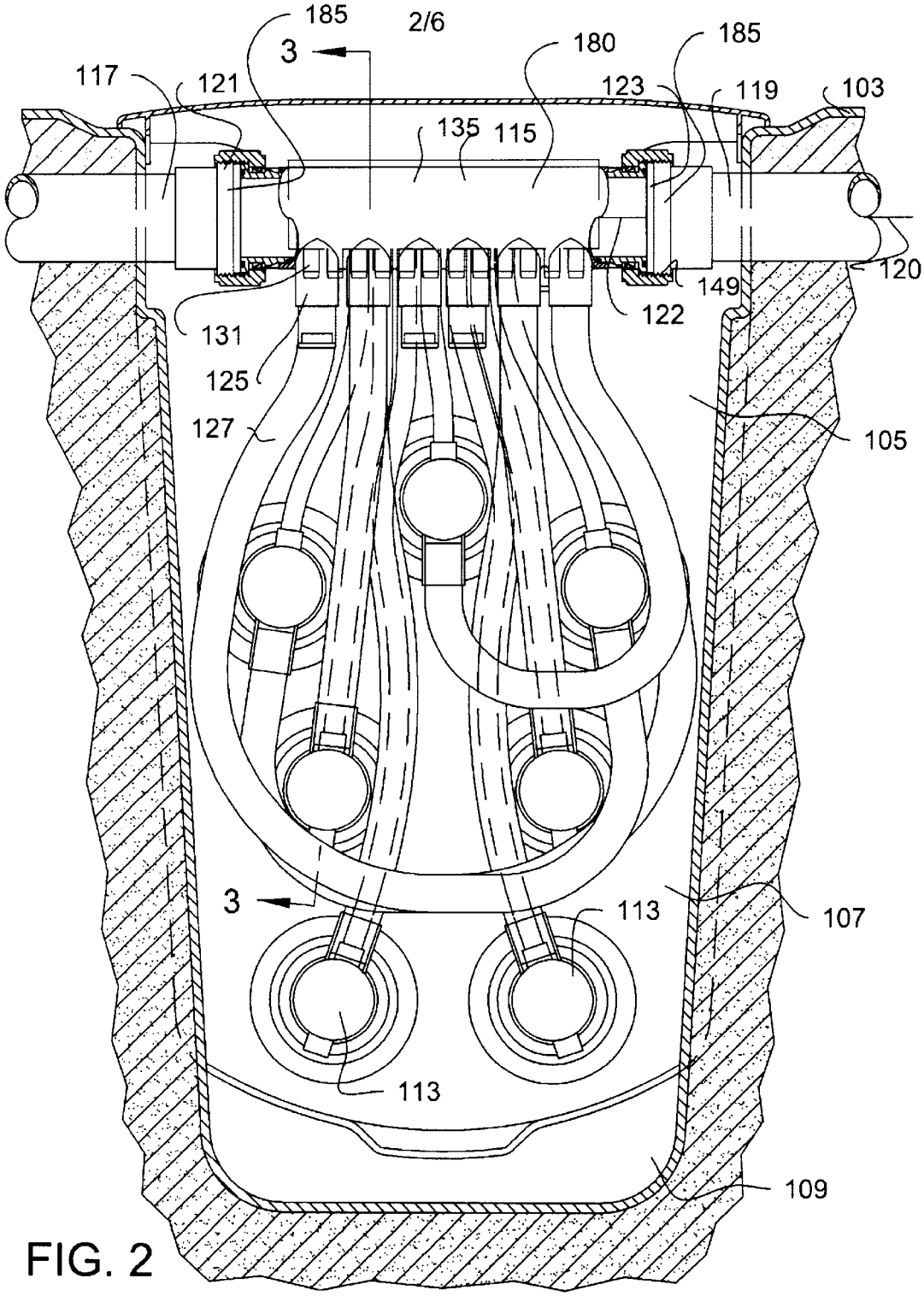
FIG. 2 is a cross-section through a hollow along 2—2 in FIG. 1, showing the manifold and jet pack assemblies as installed in the modular spa system.

Referring also to FIG. 2, also molded into the shell 103 are hollows 107. Fitted within the hollows 107 are jet packs 109 that comprise a cover 111 fitted to the opening of the hollow 107. Attached to the cover 111, are water jets 113 that are directed into the containment 105.

Figure 3:
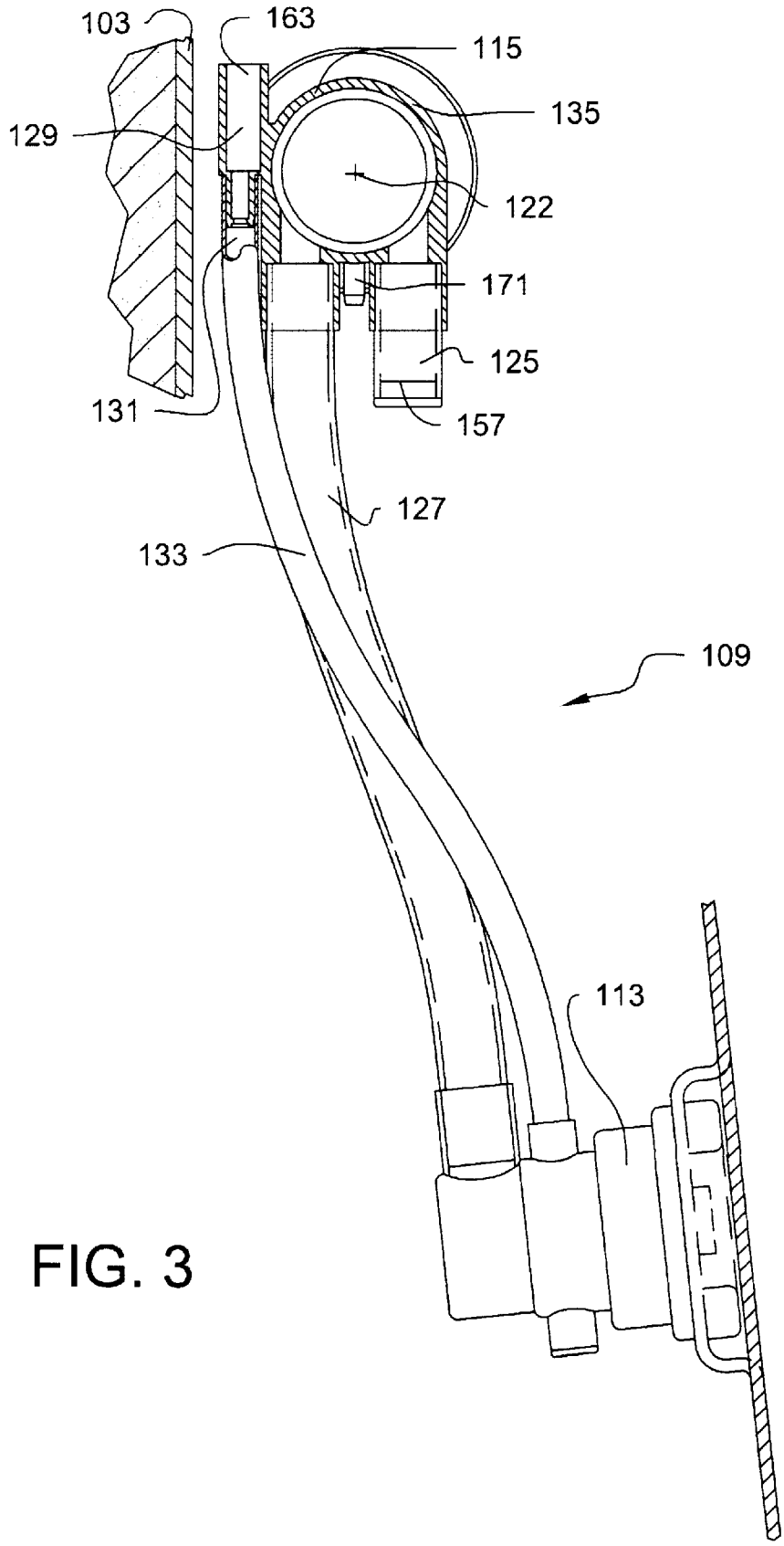
FIG. 3 is a cross-section along 3—3 in FIG. 2.
Figure 4:
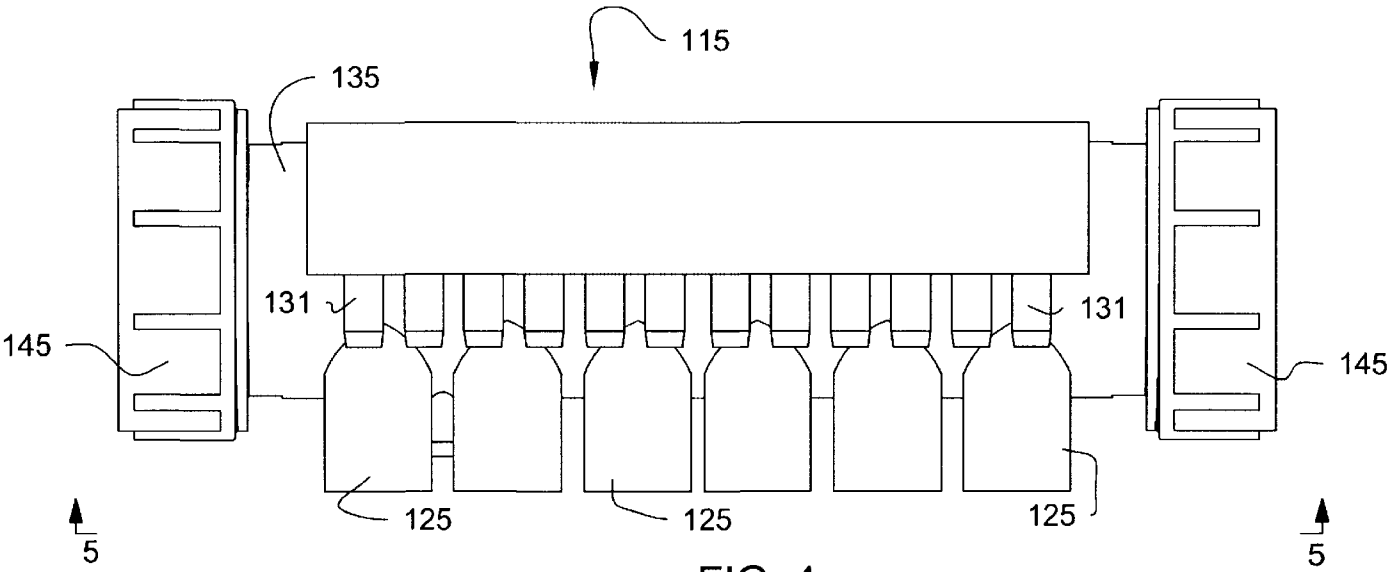
FIG. 4 is a view from the side of the manifold in FIG. 2.
Figure 5:
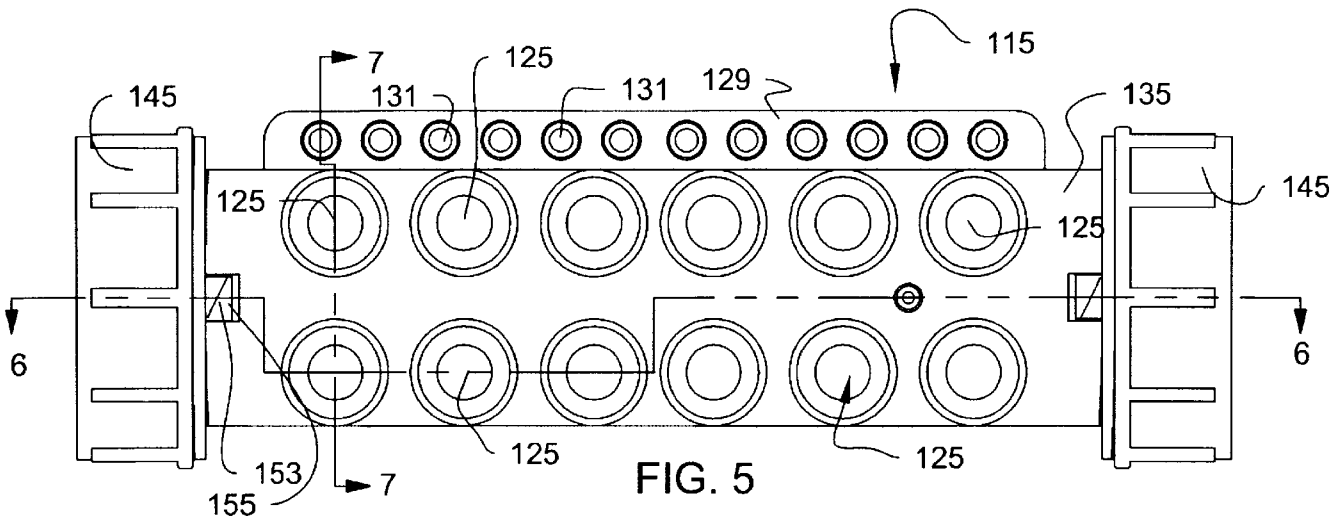
FIG. 5 is a view of the manifold in FIG. 4 viewed from below.
Figure 6:
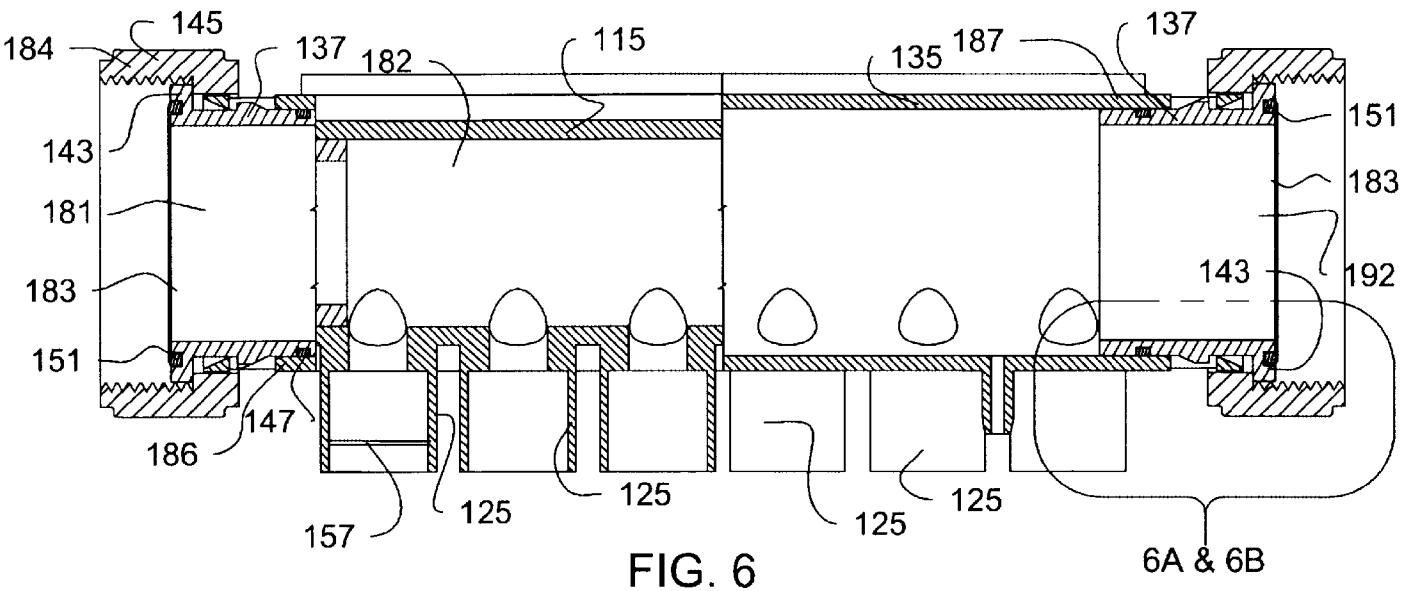
FIG. 6 is a cross-section of the manifold along line 6—6 in FIG. 5.

Referring to FIGS. 2 and 3, each jet pack 109 also comprises a manifold 115. Entering the hollow 107 through penetrations in the shell are respectively, a water inlet line 117 from a water source, and a water outlet line 119 (FIG. 3), which becomes a water inlet line for any jet pack next in line. The water inlet line 117 and the water outlet line 119 are aligned on the same longitudinal axis 120, to which the longitudinal axis 122 of the manifold 115 is aligned, when the manifold is disposed between the respective ends 121, 123 of the water inlet and outlet lines 117, 119. Referring also to FIGS. 4, 5, and 6, the manifold 115 comprises water ports 125. As shown in FIGS. 2 and 3 these water ports 125 are for attachment to jet supply lines 127 that supply the jets 113 with water. The manifold 115 also includes an air supply manifold 129 and air ports 131. As shown in FIG. 3, the air ports are for attachment to air supply lines 133 that supply the jets 113 with air.

Reference in now made to FIGS. 4, 5, 6, 7, and 8. The manifold 115 comprises a main section 135. The main section 135 is integrated, i.e., manufactured as single unit by any suitable process, preferably by molding. The ends of the main section 135 are tubular, and at either end of the main section 135 are tubular end sections that slide inward or outward. In the illustrated embodiment, the ends of the main section overlap the outside of the end sections, but alternately the end sections could overlap the outside of the ends of the main section.

The proximate ends 139 of the end sections 137 extend into the interior or channel 188 of the main section in the telescoping arrangement. The distal ends 141 are configured with structure to attach to a water line, an outwardly extending lip 143 to engage the female sleeve of a union-type connection. The telescoping arrangement of the main section 135 and end section 137 allows the total length of the manifold to be adjusted. This allows an easier installation between a water inlet line 117 and water outlet line 119, and ensures a proper length for a water seal with the water lines. To ensure a seal between the end sections 137 and the main section 135, suitable seals 147 are provided. To provide the telescoping construction, a sliding arrangement between the main section and the end sections is preferred for the simplicity of installation of the manifold, ease of manufacture, and ease of providing a water seal. However, other telescoping constructions that allow the end sections to move along the main section and change the length of the manifold are contemplated, such as, for example, a threaded construction.

Figure 6B:
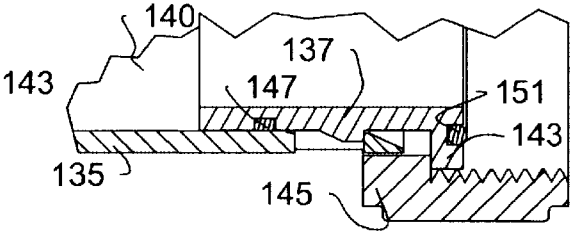
FIGS. 6A and 6B are details views of the manifold in FIG. 6, illustrating the operation of the manifold for installation.
Figure 6A:
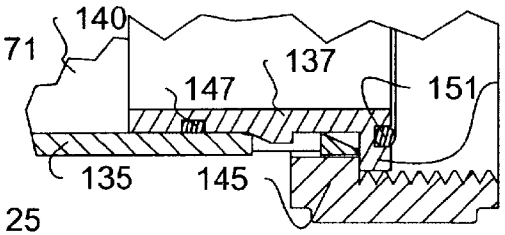

Referring to FIGS. 2, 6A and 6B, which show how an end section 137 is moved inwardly and outwardly (as shown by the arrows) to adjust the length of the manifold 115. A typical installation involves pushing the end section inward to allow easy insertion of the manifold between ends of a water inlet and a water outlet line 117, 119. When the manifold 115 is lined up and telescoping section are pulled out to place the distal ends 141 of the end section in sealing arrangement with the ends of the water inlet 117 and outlet lines 119. The ends of the water inlet and outlet lines are configured with male union threads 149 (FIG. 2) to mate with the female union sleeve 145 on the end sections. The union sleeves 145 are tightened on the male union threads to provide a secure connection and water seal. Suitable seals 151 are provided to assist in the water seal of the union. The main section 135 and end sections 137 may be keyed to prevent rotation of the end sections and ease tightening of the unions by, for example, the protrusions 153 on the end sections 137 and matching apertures 155 in the main section 135, as is shown in the figures. Other suitable constructions are contemplated to prevent rotation, such as non-circular cross-sections. Union connections are shown in the figures, but any connection system that allows for connection and reconnection as a threaded or other union connection is suitable. These may include, but are not limited to, bayonet connections, clamped flanges, compressed annular seal connections, and the like.

The main section comprises the water ports 125 for attachment of the water lines to water jets. As illustrated particularly in FIG. 6, the water ports are preferably molded as an integral part of the main section 135. In a preferred amended the water ports 125 are closed when they are manufactured by a thin break out wall or plug 157. During installation of a manifold the installer punches out the thin wall 157 before attaching a jet water supply line thereto. Only the breakout walls 157 of those water ports that are actually used are punched out with unused left unpunched. This allows the same manifold to be used for several jet pack configuration, with one, two, or several water jets. Alternately, unused ports may be closed with suitable plugs if they have been drilled or punched out or molded without a closure. The jet water supply lines 127 are attached to the water ports 125 by any suitable method, such as friction fittings, screw fittings, bayonet fittings, compression fittings or rings, adhesives, or any suitable construction.

Figure 7:
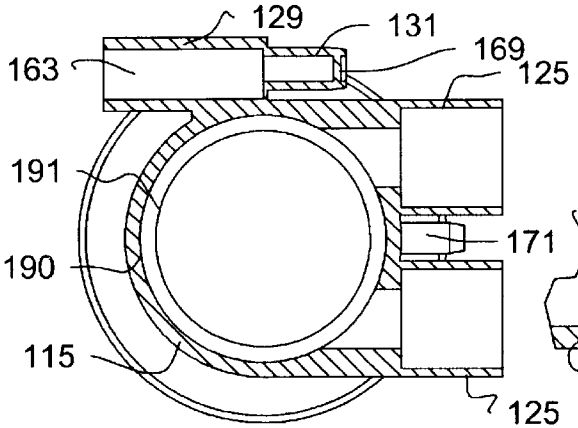
FIG. 7 is a cross-section through line 7—7 of the manifold shown in FIG. 5.

Referring particularly to FIGS. 6, and 7, if the spa construction is to have air supply lines 133 to the jets, the manifold 115 may include an air supply structure that is preferably integral and molded with the main section 135. The air supply structure comprises an air manifold 129 with an opening 163 that will be placed above the water line. From the air manifold 129 is one or more air ports 131 constructed for connection to jet air supply lines 133 that lead to jets. As manufactured, the air ports also have breakaway plugs or walls 169, that are broken only upon connection of an air line to the port.

Figure 8:
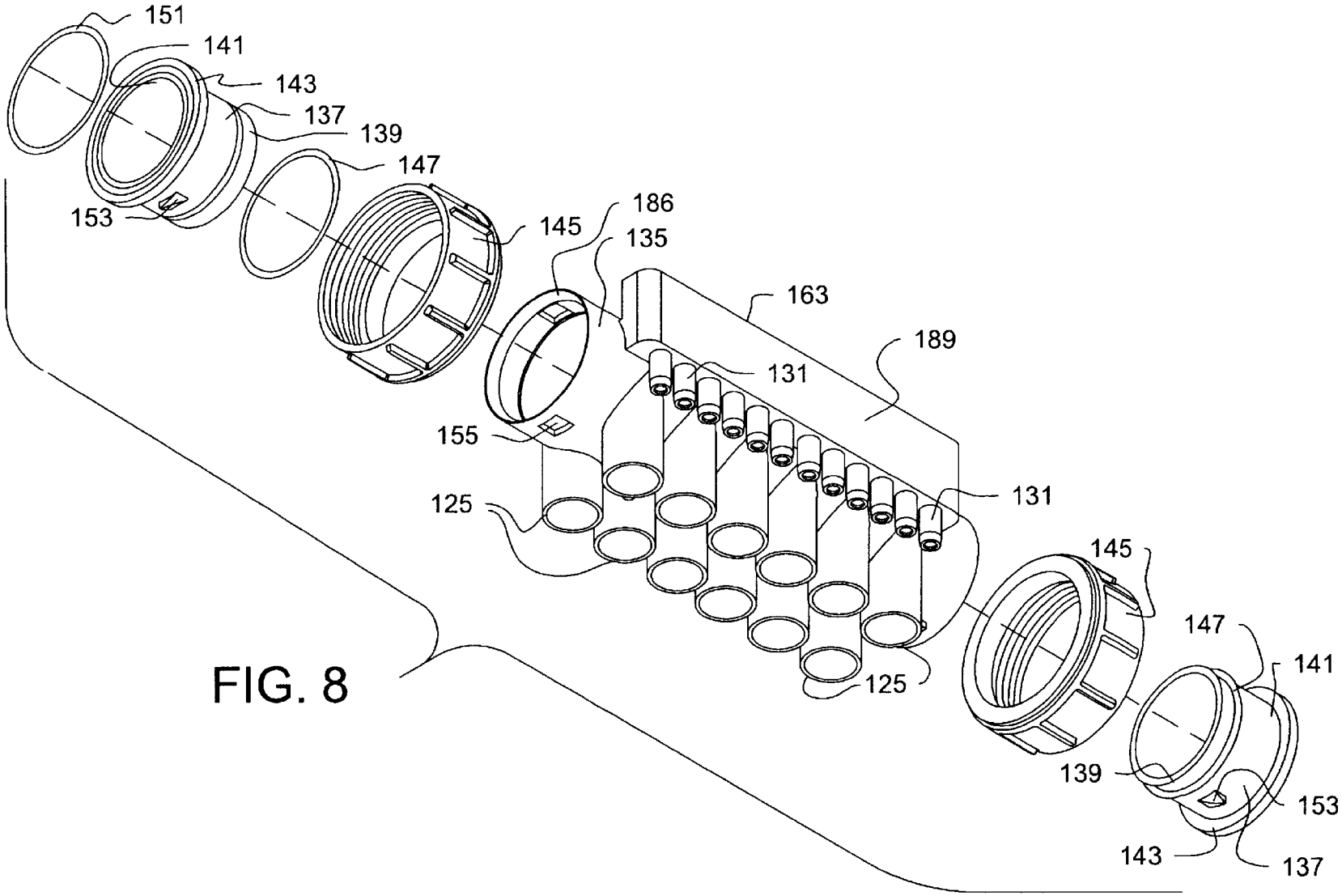
FIG. 8 is a perspective view from below of the manifold of the invention.

Referring to FIGS. 3 and 8, an antisiphon 171 port may be optionally added to the manifold to protect against a backflow by preventing a siphon being created between the water in the spa containment and the water supply system.

As compared to the prior-art manifolds, the advantages of manufacture of the manifold of the invention are evident. In the illustrated embodiment, there are only five molded parts (main section, two end sections, and female union connectors) for the manifold. Assembly of these parts and the four seals involves a simple hand assembly with no glued joints. Insertion between the water lines is simple, and adjustment of the length to the precise tolerance required for a water seal is simple.

In summary, with reference to the drawings, the present invention involves a water distribution system 180 for a bathing or spa vessel comprising a shell 103 for containment of water. The water distribution system comprises a manifold 115 comprising at least one water port 125 for supplying water to a water jet 113, a water inlet 181, a hollow interior 182 to provide water communication between the water inlet and the water port, and attachment ends 183 with structure 184 for fitting the manifold to two fixed attachments 185 on the vessel. A tubular main section 135 is provided that has a first end 186 and a second end 187 with a channel 188 between the first end and the second end, and structure 189 integral with the main section to provide the water port and water port communication with the channel.

The system also contemplates a tubular end section 137 attached at a proximate end to a first end 186 of the main section in an overlapping, telescoping construction to provide a water seal 147 between the end section and the main section while enabling the end section to move along the main section. The end section has a distal end 141 comprises structure 145 to provide one of the attachment ends of the manifold such that when the tubular end section is moved along the main section, distance between the attachment ends is adjusted to correspond the attachment ends to the two fixed attachments to allow the fitting of the attachment ends to the fixed attachments. The main section and the end section have cooperating structures 153, 155 to prevent relative rotation between the main section and the end section. The tubular main section and the tubular end section may both be cylindrical with a circular cross-section 190, 191, respectively.

One of the two attachment ends may also include structure for the water inlet 181. One of the attachment ends may also include structure 145 for a water outlet 192. Both of the two attachment ends may include structure 145 for respectively a water inlet 181 and a water outlet 191. The two attachments to the vessel may include structure to provide or be a water line for a water supply and a water line for water withdrawal aligned on a common longitudinal axis. The water inlet and water outlet structure 145 may also provide a water seal 143 for the water inlet and water outlet.

While this invention has been described with reference to certain specific embodiments and examples, it will be recognized by those skilled in the art that many variations are possible without departing from the scope and spirit of this invention, and that the invention, as described by the claims, is intended to cover all changes and modifications of the invention which do not depart from the spirit of the invention.

What is claimed is:

1. In a water distribution system for a bathing or spa vessel comprising a shell for containment of water, where the water distribution system comprises a manifold comprising at least one water port for supplying water to a water jet, a water inlet, a hollow interior to provide water communication between the water inlet and the water port, and attachment ends with structure for fitting the manifold to two fixed attachments on the vessel the improvement being the manifold further comprising;

a tubular main section with a first end and a second end with a channel between the first end and the second end, and integral structure to provide the water port and water port communication with the channel, a tubular end section attached at proximate end to a first end of the main section in an overlapping, telescoping construction to provide a water seal between the end section and the main section while enabling the end section to move along the main section, the end section having a distal end comprising structure to provide one of the attachment ends of the manifold such that when the tubular end section is moved along the main section, distance between the attachment ends is adjusted to correspond the attachment ends to the two fixed attachments to allow the fitting of the attachment ends to the fixed attachments the main section and the end section having cooperating structures to prevent relative rotation between the main section and the end section.

2. A water distribution system as in claim 1 wherein the manifold comprises only one end section and the second end of the main section has structure to provide the other of the attachment ends.

3. A water distribution system as in claim 1 wherein the manifold comprises two end sections and the distal ends of the two end sections provide the two attachment ends of the manifold.

4. A water distribution system as in claim 1 wherein one of the two attachment ends also comprises structure for the water inlet.

5. A water distribution system as in claim 1 wherein one of the two attachment ends also comprises structure for a water outlet.

6. A water distribution system as in claim 1 wherein the two attachment ends comprise structure for respectively a water inlet and a water outlet.

7. A water distribution system as in claim 1 wherein the two attachment ends comprise structure for respectively a water inlet and a water outlet and the attachments to the vessel are, respectively, a water line for a water supply and a water line for water withdrawal aligned on a common longitudinal axis.

8. A water distribution system as in claim 1 wherein the two attachment ends comprise structure for respectively a water inlet and a water outlet and the attachments to the vessel are, respectively, a water line for a water supply and a water line for water withdrawal aligned on a common longitudinal axis, and wherein the structure at the attachments ends to attachments s on the vessel provides a water seal for the water inlet and water outlet.

9. A water distribution system as in claim 1 wherein the manifold is an integral structure that provides water ports molded with the main section.

10. A water distribution system as in claim 9 wherein a plurality of water ports are provided, and each of the molded ports has a breakable wall in the port to block passage of water through port and which water port can be broken away before the water port is connected to a jet water supply line to permit water to pass through the water port and through the jet water supply line.

11. A water distribution system as in claim 1 wherein the overlapping, telescoping construction comprises sliding seals that provide the water seal while allowing the main section and the end section to slide relative to each other.

12. A water distribution system as in claim 1 wherein the main section also comprises structure to supply air to the jet.

13. A water distribution system as in claim 12 wherein the structure to supply air comprises an air supply manifold and at least one air port to provide an air supply for the jet.

14. A water distribution system as in claim 13 wherein the integral structure to provide the air port is molded with the main section.

15. A water distribution system as in claim 14 wherein a plurality of air ports are provided, and each of the as-molded air ports has a breakable wall in the air port to block passage of air through the air port and which can be broken away before the air port is connected to a jet air supply line to permit air to pass through the water port and through the jet air supply line.

16. A water distribution system as in claim 14 wherein the structure for attachment to either of the water lines comprises a threaded union connection.

17. A water distribution system as in claim 1 wherein the tubular main section and the tubular end section are cylindrical with a circular cross-section.

18. A water distribution system as in claim 1 wherein the structures to prevent relative rotation comprise a protrusion on the end section that extends through an aperture on the main section.

* * * * *